US005769243A

United States Patent [19]

McCarthy

[11] Patent Number: 5,769,243

[45] Date of Patent: Jun. 23, 1998

[54] THROUGH-FLOW CLEANER WITH IMPROVED INLET SECTION

[75] Inventor: Christopher E. McCarthy, Middletown, Ohio

[73] Assignee: Thermo Black Clawson Inc., Middletown, Ohio

[21] Appl. No.: 688,398

[22] Filed: Jul. 30, 1996

[51] Int. Cl.[6] ..... B04C 3/04

[52] U.S. Cl. ..... 209/725; 209/734; 210/512.2

[58] Field of Search ..... 209/725, 727, 209/729, 732, 733, 734; 210/512.1, 512.2, 512.3

[56] References Cited

U.S. PATENT DOCUMENTS

| | | | |
|---|---|---|---|
| 2,377,524 | 6/1945 | Samson et al. | 209/733 X |
| 3,096,275 | 7/1963 | Tomlinson, II | 209/734 X |
| 3,754,655 | 8/1973 | Troland | 210/512.1 X |
| 4,155,839 | 5/1979 | Seifert et al. | 209/734 X |
| 4,473,478 | 9/1984 | Chivrall | 209/732 X |
| 4,581,142 | 4/1986 | Fladby et al. | 210/512.1 |
| 5,566,835 | 10/1996 | Grimes | 209/733 X |

FOREIGN PATENT DOCUMENTS

| | | | |
|---|---|---|---|
| 1222220 | 5/1987 | Canada . | |
| 0137084 | 4/1985 | European Pat. Off. . | |
| 348235 | 8/1972 | U.S.S.R. | 209/732 |
| 471905 | 5/1975 | U.S.S.R. | 209/732 |

OTHER PUBLICATIONS

3" *X–Clone Black Clawson Through Flow Centrifugal Cleaners*, Bulletin No. 75–SB, The Black Clawson Company, BC Shartle–Pandia Div.

*Ultra Clone Forward Cleaner*, Bulletin No. MB–323, The Black Clawson Company.

*Primary Examiner*—Joseph E. Valenza
*Assistant Examiner*—Tuan N. Nguyen
*Attorney, Agent, or Firm*—Biebel & French

[57] ABSTRACT

A hydrocyclone for separating lightweight contaminants from a suspension of papermakers'stock as a through-flow design in which an inlet section has a frusto-conical flow controlling wall and has a central flow stabilizer and a tangential inlet. The flow stabilizer has a paraboloid shape and defines with the flow control wall an annular flow space of constant area along the axial length of the flow stabilizer so that fluid entering a tangential inlet at the base of the paraboloid is caused to rotate about the flow stabilizer and is delivered to the interior of the hydrocyclone without a substantial change in axial velocity.

5 Claims, 2 Drawing Sheets

THROUGH-FLOW CLEANER WITH IMPROVED INLET SECTION

This invention relates to hydrocyclone cleaners and more particularly to a through-flow type cleaner having an improved inlet section with improved flow stabilization.

Through-flow type hydrocyclone cleaners have become useful in certain specific applications in the cleaning of papermakers'stock. A through-flow cleaner gets its name from the fact that the stock to be cleaned is applied at an inlet, usually a tangential inlet, at one end of an elongated tube-type hydrocyclone body, and both the accepts and rejects are taken from a remote end, without flow reversal.

Through-flow cleaners are useful particularly by reason of their low hydraulic reject rate, which is usually in the order of about 10 to 15%. It can concentrate light-weight contaminants in low consistency stock since it is not necessary for these contaminants to undergo a flow reversal within the hydrocyclone. Through-flow cleaners are also characterized by a low loss of solids, and can reduce the final reject volume and solids. Further, they conserve energy since they have low pressure drops compared to conventional forward or reverse flow cleaners.

Applications of through-flow cleaners as well as other types of hydrocyclone cleaners, including reverse cleaners, are described in Bliss, "Through-flow Cleaners Offer Good Efficiency With Low Pressure Drop", Paper & Pulp, March 1985.

A conventional through-flow cleaner is the X-Clone cleaner made by The Black Clawson Company, Shartle Division, Middletown, Ohio and described in U.S. Pat. No. 4,564,443. A tangential inlet is positioned immediately radially outwardly of a stabilizer at the inlet end of a cylindrical body section. The stabilizer provides a measure of stability to a tangential flow as it merges and proceeds into the interior of the cylindrical section and moves toward a conical section of the body. The stabilizer forms with the cylindrical body an increasing flow area prior to entering the conical body section. This results in a deceleration of the tangential flow, and promotes instability and shear mixing in the stock suspension.

SUMMARY OF THE INVENTION

This invention is directed particularly to a through-flow hydrocyclone cleaner having an improved inlet section in which the flow controlling wall of the inlet section is not cylindrical but rather is frustoconical, and in which a central stabilizer member is not conical or cylindrical but rather is formed with a surface which, taken with the frusto-conical wall of the inlet, provides a relatively constant cross-sectional area at all axial positions from a tangential inlet. In this manner, the inlet area, as seen by the inflowing tangentially rotating stock, does not substantially change, and the flow from the inlet section is delivered to the elongated separating section at a velocity which closely approximates the inlet velocity thereby enhancing stability of the flow and reducing shear mixing which occurs when the flow is accelerated or decelerated.

More particularly, the cross-sectional area measured radially or orthogonally along the longitudinal axis, from the inside diameter of the frusto-conical inlet wall to the outside diameter of the flow stabilizer is substantially uniform at each axial point. In the preferred embodiment it is also substantially equal to the inside area of the cylindrical section of the hydrocyclone. This arrangement eliminates the usual volume increase, resulting in a necessary slowing down of the rotational velocity and inherently creates undesirable mixing within the hydrocyclone. The conical-to-cylindrical inlet section creates a condition in which the inflow sees a constant volume throughout and results in increased stability which can be confirmed by observing the air core within the hydrocyclone. The stability of the air core is a direct result of the rotational stability of the fluid.

A second factor which contributes to the stability of the design is the fact that the inlet open cross-sectional area forming the tangential opening, which matches the opening through which the flow enters into the hydrocyclone. Therefore, considering that the column of fluid which enters through the inlet accelerates angularly, and makes a rotation, the flow in this rotation volume does not travel inside or above the incoming flow, but along a helical path. This can be distinguished from many through-flow cleaners or other hydrodynamic papermakers'stock cleaning devices, in which the area of the inlet does not completely fill the entrance zone thus, inherently creating mixing at the inlet.

The inlet section includes a conical flow controlling portion of the body with a closed end. The axial length of the inlet section equals the height of the central flow stabilizer. The outer surface curvature of the stabilizer is approximately parabolic and provides, with the inside tapered conical wall, an approximation of constant area leading from a generally rectangular inlet at the closed end along the surface of the stabilizer, to the tip of the stabilizer.

The tapered inlet section preferably joins with a cylindrical section of an elongated cyclone separator, without substantial change in flow area. The increase in cleaning efficiency is the result of a greater stabilization of flow, is visually observed as a stable vortex core. The stability is the result of a velocity stability with substantially decreased shear mixing as compared to the inlet adapters of conventional through-flow hydrocyclone cleaners.

It is accordingly an important object of the invention to provide a through-flow hydrocyclone cleaner for papermakers'stock having reduced velocity changing characteristics and providing for increased flow stability translating into increased flow separation efficiency.

A further object of the invention is the provision of a frusto-conical inlet section having therein a flow stabilizer of a parabolic surface of revolution forming a paraboloid with its long axis positioned on the central axis of the frusto-conical section and with its base at a tangential inlet, and in which the stock inlet fills the radial space between the paraboloid at the base and inside wall of the housing.

A still further object of the invention is the provision of a hydrocyclone through-flow cleaner for papermakers'stock, particularly adapted for operation at low inlet consistencies and low pressure drop, with high stability and improved separation characteristics.

Other objects and advantages of the invention will be apparent from the following description, the accompanying drawings and the appended claims.

DESCRIPTION OF PREFERRED EMBODIMENT

Figure 1:
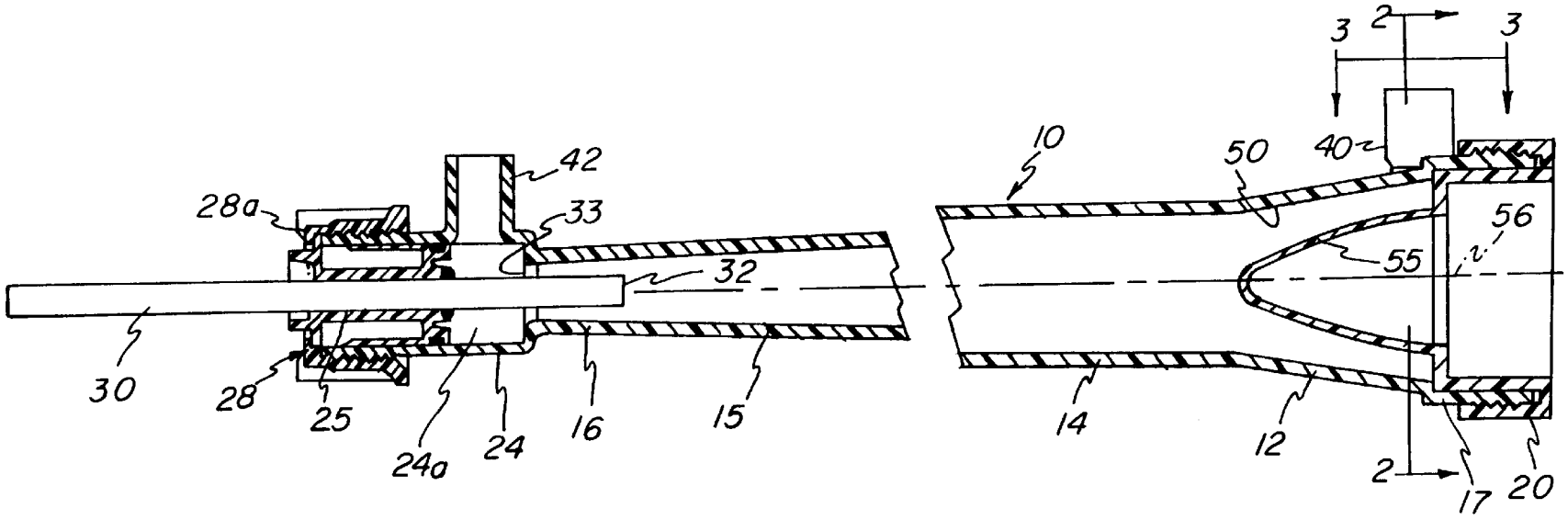
FIG. 1 is a sectional view, partially broken away, of a through-flow hydrocyclone separator according to this invention.

A through-flow hydrocyclone papermakers'cleaner or separator is illustrated generally at 10 in FIG. 1. The working components of the cleaner 10 are illustrated but it is understood that the cleaner may, if desired, be located or positioned within an exterior housing generally of the kind described in the previously mentioned U.S. Pat. No. 4,564, 443.

The through-flow cleaner may be considered generally as having an inlet section 12, an intermediate cylindrical section 14, a tapered or conical section 15, and an outlet end 16. The sections 14 and 15 together form an elongated cyclone separating section. The several sections of the cleaner 10 may be formed as a continuous molding of a suitable plastic material, and therefore made in one piece.

The generally conical inlet section 12 has an enlarged annular portion 17 which is threaded to receive an end cap 20 for closing the enlarged portion 17.

The smaller outlet end 16 of the elongated tapered section 15 terminates in a somewhat enlarged cylindrical end 24 which defines a cylindrical chamber 24*a* therein. A removable closure plug 25 is positioned within the interior of the end 24, within the chamber 24*a*, and is sealed to the walls of the chamber by an O-ring. The plug 25 is retained by an annular threaded plug retainer 28. The retainer 28 is received over external threads formed on the outer surface of the enlarged end 24, and has an inwardly turned flange 28*a* which engages the plug 25 and holds it in a predetermined place within the chamber 24*a*.

The plug 25 has an axial opening through which a vortex finder tube 30 is adjustably positioned, with an inner end 32 extending somewhat into the interior of the conical section 15. An annular accepts passage 33 is defined between the outer diameter of the tube 30 and the wall of the conical section 15, leading into the chamber 24*a*. An inner O-ring seal on the plug 25 forms a fluid tight seal with the outside surface of the vortex finder tube 30.

The inlet section 12 includes a stock inlet 40, the details of which are described below, while the chamber 24*a* is formed with an accepts outlet 42. The outlet 42 is positioned between the passage 33 and the plug 25. The inlet 40 and outlet 42 are formed as integral parts of the housing defining the respective sections of the hydrocyclone. A rejects outlet is formed by the tube 30, through which separated air and lightweight contaminants are removed. As described in U.S. Patent '443, the tube 30 may be withdrawn through the annular outlet 33 for the purpose of cleaning and removing any fibers which may plug the annulus 33.

Figure 2:
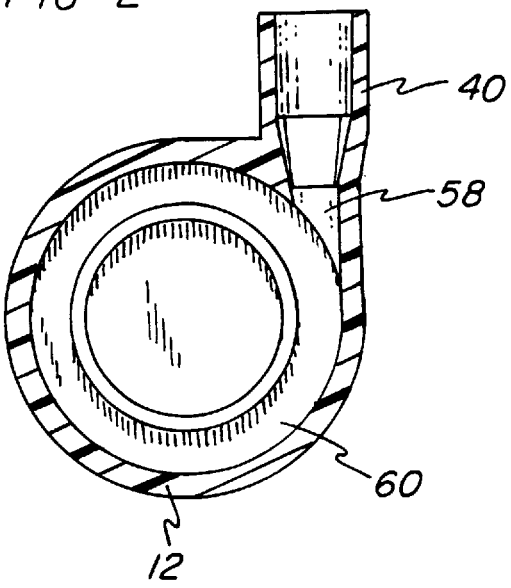
FIG. 2 is an enlarged transverse sectional view through the inlet section end of the separator taken generally along the line 2—2 of FIG. 1.
Figure 3:
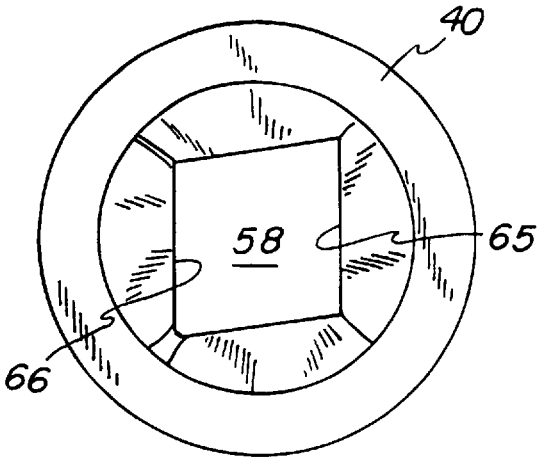
FIG. 3 is an enlarged view of the stock inlet as viewed along lines 3—3 of FIG. 1.
Figure 4:
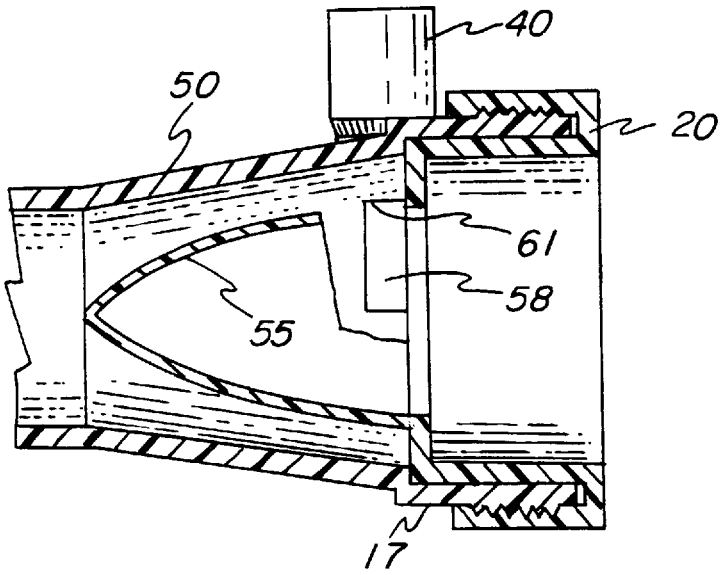
FIG. 4 is an enlarged partially fragmentary section through the inlet section with a portion of the stabilizer being broken away to illustrate the inlet opening.

Referring to the sectional views of FIGS. 2–4, the inlet section 12 has a body which is generally frusto-conical in shape and defines a controlling portion with an inner surface 50. The end cap 20, which closes the inlet end of the cleaner, is configured with an integral symmetrical projection which extends into the interior of the section 12 and which has a height equal to the axial length of the conical section 12. The projection forms a stabilizer 55. The flow stabilizer 55 is positioned symmetrically of the central axis 56 of the cleaner, within the conical section 12. The stabilizer 55 preferably has a profile, in section, of a parabola, but in some cases, it is considered that satisfactory results could be obtained by a stabilizer, in cross-section, having the shape of an ellipse.

The stabilizer 55 operates in conjunction with the stock inlet 40 which, as viewed in FIG. 3, tapers from a round opening to a final inlet passage 58 which is generally rectangular in cross-section when it intersects the interior. The passageway 58 extends along the inside wall of the inlet section in tangential manner and offset from the axis, as illustrated in FIG. 3. The passage 58 has a width which fills the radial width of an annular space 60 (FIG. 2) between the base of the flow stabilizer 55 and the cap 20 at the wall 61 (FIG. 4). Thus, the back wall 65 of the inlet passage 58 is coterminous with the radial back wall 61 formed by the face of the cap 20, while the front wall 66 lies on a tangent line to the outer surface of the stablizer 55.

The inlet area of the passage 58 is matched to the flow area in the space surrounding the outer surface of the stablizer 55 and the radially opposite inside surface of the frusto-conical inlet section 12, and there is no flow which can travel inside or above this incoming flow. The flow can only make a rotation and move axially of the conical section 12.

The slope of the conical flow controlling portion, together with the curvature of the outer surface defined by the stabilizer 55, throughout the entire axial length of the section 12, provides a uniformly constant flow area measured radially at any axial position along the conical section leading into the cylindrical section 14. At the plane of junction of the frusto-conical section 12 and the cylindrical section 14, the respective open areas are the same. Accordingly, the flow of the stock suspension from the inlet 40, after entering the passage 58, remains uniform in axial velocity throughout the inlet section 12 and also the length of the cylindrical section 14.

The decreasing taper of the relatively longer tapered section 15 accelerates the rotational velocity slowly, increasing the centrifugal force on the heavier fibers and segregating the light-weight contaminants in the vortex cone area for entrance into the interior of the rejects finder tube 30. Separation therefore begins to occur immediately at the inlet passage 58 with angular acceleration free of countervailing forces, and flows that would otherwise be due to sudden increases in area, as characteristic of prior through-flow stock preparation cleaners.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a hydrocyclone separator for separating lightweight contaminants from a suspension of papermakers'stock and having a central axis therethrough leading from an inlet section through an elongated separator section to an outlet section at which rejects and accepts are collected, the improvement in said inlet section comprising a frusto-conical flow controlling wall-formed with a relatively wide base at one end and formed with an outlet at the other end and located on said axis with said outlet joined with said elongated separator section for delivering a suspension of stock into said separator section, a closure closing said flow controlling wall portion at said relatively wide end and forming a radially extending annular wall at said end, a flow stabilizer on said closure having a generally parabolic shape, said flow stabilizer extending from said annular wall along said axis into said frusto-conical wall portion and terminating generally coterminous with the junction of said wall portion with said elongated separator section, said flow stabilizer defining with said frusto-conical wall section, an annular flow space of relatively constant cross-sectional area from said base annular wall to said outlet, and means in said inlet flow section forming a tangential inlet opening into the annular space at said annular wall for directing fluid tangentially into said annular space, whereby fluid entering said inlet section is caused to rotate within said frusto-conical wall about said flow stablizer and delivered to said elongated separator section without making a substantial change in axial velocity.

2. In hydrocyclone apparatus for separating lightweight contaminants from a suspension of papermakers'stock in the form of a through-flow cyclonic cleaner having a central axis therethrough and having an inlet section for imparting a rotational cyclonic flow to such stock for delivery to an elongated cyclone separating section terminating in an outlet section having an accepts outlet and having a rejects outlet located on said axis, the improvement comprising said inlet section having a flow controlling wall portion of frusto-conical shape on said axis and having its smaller end connected to deliver stock into said cyclone separating section, a closure plug closing the larger end of said flow controlling wall portion, said closure plug forming a radially extending wall at said larger end and having an integral flow stabilizer of generally paraboloid shape extending into said wall portion on said axis, said flow stabilizer defining with said inlet wall portion an annular flow space having a relatively constant cross-sectional area from said base annular wall to said outlet end, and a tangential inlet in said inlet section opening into said annular space at said radial wall whereby stock entering said apparatus through said tangential inlet is caused to rotate within said frusto-conical wall portion about said flow stabilizer for delivery from said inlet section to said separating section without incurring a substantial change axial in velocity.

3. Hydrocyclone apparatus for separating lightweight contaminants from a suspension of papermakers'stock comprising a through-flow cyclonic cleaner defining a central axis therethrough and having an inlet section, a cylindrical section forming a continuation of said inlet section, and a conical converging section, said conical converging section terminating in an accepts outlet and having therein a rejects tube located on said axis concentric with said accepts outlet, said inlet section including a flow controlling portion of frusto-conical shape on said axis with its relatively narrow outlet joined with said cylindrical section, and having the same diameter as said cylindrical section, a closure plug closing said cylindrical section at the larger end thereof and forming a radially extending annular wall, a flow stabilizer of extending from said wall on said axis into said flow controlling portion and having a terminal end generally coterminous with the junction of said inlet section with said cylindrical section, said stabilizer defining with said flow space of relatively constant cross-sectional area from an annular wall to said end, and a tangential inlet in said inlet section opening into the radial space between said stabilizer at said annular wall whereby said fluid entering said separator through said tangential inlet is caused to rotate within said inlet section about said stabilizer and delivered from said inlet section to said cylindrical section without a substantial change in velocity.

4. A hydrocyclone apparatus according to claim 3 in which said tangential inlet is formed with a generally rectangular passageway, one wall of said passageway lying generally in a plane defined by said annular wall, and another wall thereof being in tangential relation to an inside surface of said flow controlling portion.

5. A hydrocyclone apparatus according to claim 3 in which said inlet fills the radial space between said flow controlling portion and said flow stabilizer at said annular wall.

* * * * *